US009302462B2

(12) United States Patent
Livingston

(10) Patent No.: US 9,302,462 B2
(45) Date of Patent: Apr. 5, 2016

(54) TEXTILE PRINTING APPARATUS AND METHOD

(71) Applicant: Livingston Systems, LLC, Northglenn, CO (US)

(72) Inventor: Darren Livingston, Northglenn, CO (US)

(73) Assignee: Livingston Systems, LLC, Northglenn, CO (US)

( * ) Notice: Subject to any disclaimer, the term of this patent is extended or adjusted under 35 U.S.C. 154(b) by 0 days.

(21) Appl. No.: 14/738,318

(22) Filed: Jun. 12, 2015

(65) Prior Publication Data

US 2015/0360460 A1 Dec. 17, 2015

Related U.S. Application Data

(60) Provisional application No. 62/012,412, filed on Jun. 15, 2014.

(51) Int. Cl.
*B41F 15/18* (2006.01)
*B41F 17/38* (2006.01)
*B41J 3/407* (2006.01)

(52) U.S. Cl.
CPC ..... *B41F 15/18* (2013.01); *B41F 17/38* (2013.01); *B41J 3/4078* (2013.01)

(58) Field of Classification Search
CPC ..... B41F 15/0863; B41F 15/14; B41F 15/16; B41F 15/18; B41F 15/26; B41F 17/38; B41F 17/003; B41F 17/005; B41P 2217/61; B41P 2215/50; B41M 1/12; B41J 3/4078
USPC ..... 101/41, 115, 126, 474; 223/71
See application file for complete search history.

(56) References Cited

U.S. PATENT DOCUMENTS 6,651,554 B1 * 11/2003 Williams ..... B41F 15/26 101/126
7,413,301 B2 * 8/2008 Niimi ..... B41J 2/01 101/126
2004/0000240 A1 * 1/2004 Oleson ..... B41F 15/18 101/126

* cited by examiner

*Primary Examiner* — Leslie J Evanisko
(74) *Attorney, Agent, or Firm* — Trenner Law Firm, LLC; Mark D. Trenner

(57) ABSTRACT

A textile printing apparatus and method is disclosed. An example textile printing apparatus includes a first printing surface configured to support a first portion of a textile to be printed on. The example textile printing apparatus also includes a second printing surface configured to support a second portion of the textile in substantially a same printing plane as the first portion of the textile. The example textile printing apparatus also includes a slot formed adjacent the second printing surface. For a printing operation, a body of the textile is mounted over the first printing surface, and an inner portion of the textile is pulled through the slot and mounted, over the second printing surface. The printing operation proceeds in substantially the same printing plane onto both the outer printing surface and the inner printing surface without removing the textile during the printing operation.

18 Claims, 10 Drawing Sheets

TEXTILE PRINTING APPARATUS AND METHOD

CROSS REFERENCE TO RELATED APPLICATIONS

This application claims the priority benefit of U.S. Provisional Patent Application No. 62/012,412 filed Jun. 15, 2014 for "TagPrinter.pdf" of Darren D. Livingston, which is incorporated by reference in its entirety as though fully set forth herein.

BACKGROUND

Modern printing techniques enables printing designs such as logos, texts, photos, and other graphics to be printed on a wide range of textiles such as those used for garments (e.g., shirts, t-shirts, pants, hats, and other clothing items), bags (e.g., cloth grocery bags), and other accessories.

Screen printing is based on a screen with some holes blocked and other left open to allow ink to pass through at chosen locations to create a desired pattern. The screen is placed over a textile to be decorated. Ink is then pushed through the screen at the desired locations with pressure applied by a squeegee pulled or pushed over the screen with a downward force. Additional colors may be applied using a separate screen for each color. The result is a printed image on the textile. Digital, or direct-to-garment printing, utilizes a computer, software, and an ink-jet printer to print the image directly onto the textile. Both of these techniques enable printing on a smooth surface, such as a shirt.

Manufacturers and/or printers often want (or are required by law) to include a label with their printed product. In the past, these labels were printed separately and attached to the textile (e.g., by sewing below the inner collar of a shirt). More recently, these labels have been printed directly on the textile to reduce costs associated with applying a separate label and increase comfort for the wearer. However, a screen printer currently wanting to decorate the chest area of a t-shirt and also print a custom tag has to add a secondary or stand-alone operation. For example, printing a label under the inside of the shirt collar requires removing the shirt from the platen, changing screens, changing out platens, turning the shirt inside-out, and then repositioning the shirt on the platen to print the label. This can be time consuming, and thus labor intensive and more expensive.

DETAILED DESCRIPTION

A textile printing apparatus and method is disclosed. An example textile printing apparatus includes a first printing surface configured to support a first portion of a textile to be printed on. The example textile printing apparatus also includes a second printing surface configured to support a second portion of the textile in substantially a same printing plane as the first portion of the textile. The example textile printing apparatus also includes a slot formed adjacent the second printing surface. For a printing operation, a body of the textile is mounted over the first printing surface, and an inner portion of the textile is pulled through the slot and mounted over the second printing surface. The printing operation proceeds in substantially the same printing plane onto both the outer printing surface and the inner printing surface without removing the textile during the printing operation.

Before continuing, it is noted that as used herein, the terms "includes" and "including" mean, but is not limited to, "includes" or "including" and "includes at least" or "including at least." The term "based on" means "based on" and "based at least in part on." In addition, the term "textile" is intended to include traditional textiles such as a cloth or woven fabric, but may also include other substrates for which the printing operations described herein are applicable.

Figure 1:
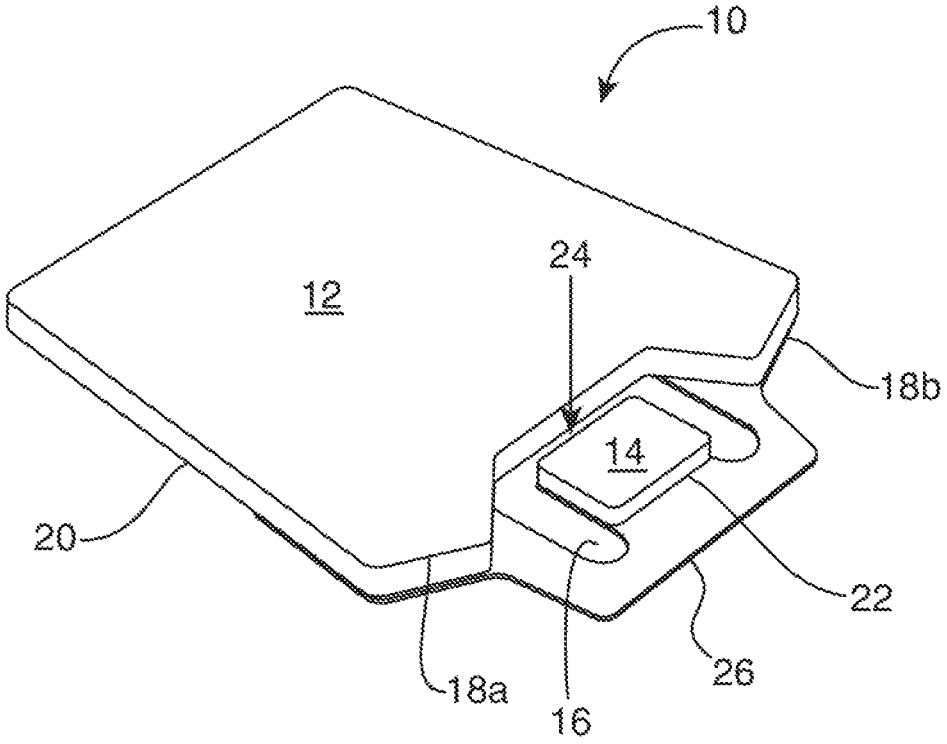
FIG. 1 shows an example textile printing apparatus.

FIG. 1 shows an example textile printing apparatus 10. In an example, the textile printing apparatus 10 includes a first printing surface 12, a second printing surface 14, and a slot 16 formed adjacent the second printing surface 14, e.g., between the first printing surface 12 and the second printing surface 14. The slot 16 may be substantially U-shaped. It is noted, however, that the slot may be any suitable shape. In addition, more than one slot may be provided.

In an example, the first printing surface 12 is configured to support a first portion of a textile to be printed on. For example, the textile may be a shirt (or t-shirt) and the first portion of the shirt is the front (and/or back) body portion of the shirt. The second printing surface 14 is configured to support a second portion of the textile in substantially a same printing plane as the first portion of the textile. For example, the second portion of the textile may be just below the thicker portion of a collar of the shirt. An example of mounting a shirt on the textile printing apparatus 10 is discussed in more detail below with reference to the illustration shown in FIG. 4.

In an example, the first printing surface 12 may be part of (or mounted to) a printing board 20. The printing board 20 may be configured as a platen (e.g., a platen configured to print a graphic on the front and/or back side of a shirt). The second surface 12 may be a part of (or mounted to) a tag board 22. The tag board 22 may also be configured as a platen (e.g., a platen configured to print a label inside the shirt collar). In an example, the tag board 22 may include a raised portion 24 and a lower portion 26. The tag board 22 may be attached to (or formed integrally as part of) the printing board 20.

It is noted that the printing board 20 and the tag board 22 may have any suitable shape. In FIG. 1, the printing board and the tag board are illustrated as being substantially rectangular in shape. However, other shapes are also contemplated. The shape and size of the printing board 20 and the tag board 22 may depend at least to some extent on design considerations (e.g., the size, shape and/or type of textile to be printed on).

In FIG. 1, the first printing surface 12 is illustrated as it may include shoulders 18*a-b*. The shoulders 18*a-b* extend around at least a portion of the slot 16, e.g., along at least a part of both sides of the second printing surface 14. The shoulders 18*a-b* may be configured to provide a level surface across the gap 24 formed between the first printing surface 12 and the second printing surface 14. As such, the shoulders 18*a-b* provide a support for a squeegee so that the squeegee passes readily across the gap 24 between the first printing surface 12 and the second printing surface 14.

Figure 2A:
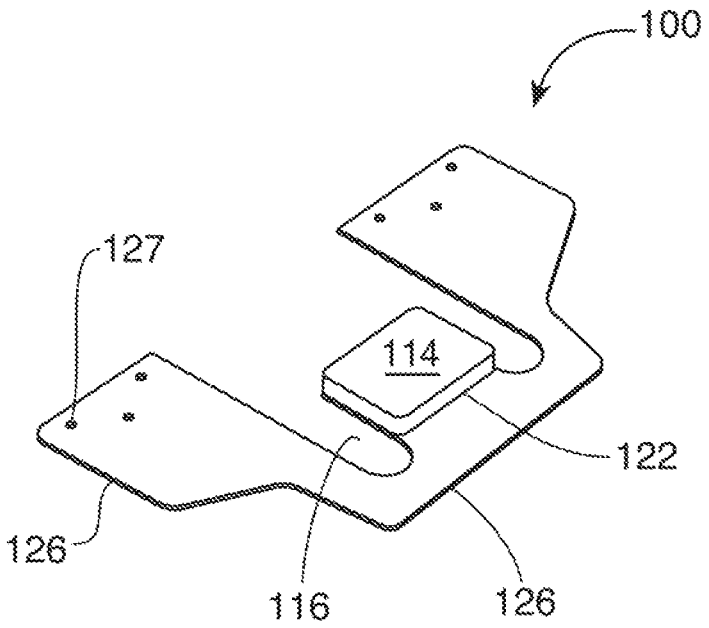
FIG. 2A shows an example textile printing apparatus configured as an attachment to a platen.
Figure 2B:
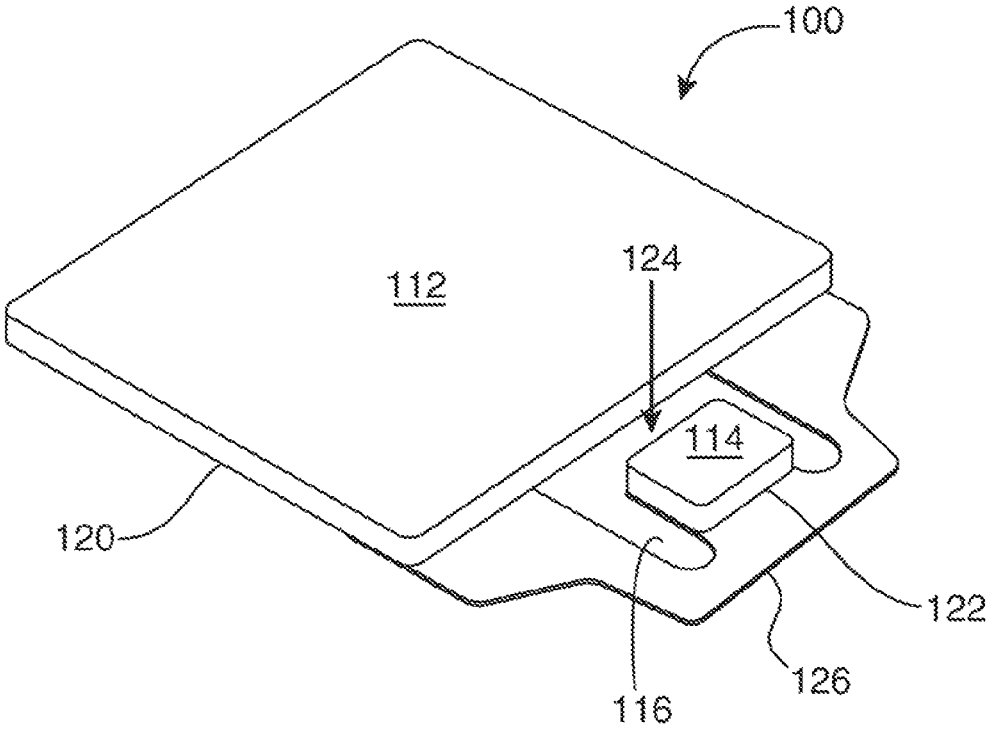
FIG. 2B shows the example textile printing apparatus of FIG. 2A attached to a printing board.

FIG. 2A shows an example textile printing apparatus 100 configured as an attachment to a platen. FIG. 2B shows the example textile printing apparatus 100 of FIG. 2A attached to a printing board.

In an example, the textile printing apparatus 100 includes a first printing surface 112, a second printing surface 114, and a slot 116 formed adjacent the second printing surface 114, e.g., between the first printing surface 112 and the second printing surface 114. The slot 116 may be substantially U-shaped. It is noted, however, that the slot may be any suitable shape. In addition, more than one slot may be provided.

In an example, the first printing surface 112 is configured to support a first portion of a textile to be printed on. For example, the textile may be a shirt (or t-shirt) and the first portion of the shirt is the front (and/or back) body portion of the shirt. The second printing surface 114 is configured to support a second portion of the textile in substantially a same printing plane as the first portion of the textile. For example, the second portion of the textile may be just below the thicker portion of a collar of the shirt. An example of mounting a shirt on the textile printing apparatus 100 is discussed in more detail below with reference to the illustration shown in FIG. 4.

In an example, the first printing surface 112 may be part of (or mounted to) a printing board 120. The printing board 120 may be configured as a platen (e.g., a platen configured to print a graphic on the front and/or back side of a shirt). The second surface 112 may be a part of (or mounted to) a tag board 122. The tag board 122 may also be configured as a platen (e.g., a platen configured to print a label inside the shirt collar). In an example, the tag board 122 may include a raised portion 124 and a lower portion 126.

In the example shown in FIGS. 2A-B, the tag board 122 is a separate accessory. For example, the tag board 122 illustrated in FIG. 2A may be provided as an attachment to a conventional printing board, or to a printing board 120 specially configured for the tag board 122. As such, the tag board 122 can be removably attached by an end user to the printing board 120. A removable tag board 122 may provide many advantages, such as but not limited to, being usable with multiple printing boards 120, providing a platen for different labels for use with the same printing boards 120, removing when label printing is not needed or desired, etc.

The tag board 122 is shown in FIG. 2A as it may be attached to the printing board 120 by screws or other threaded fasteners via holes 127 formed in the lower portion 126 of the tag board 122. However, any suitable connection may be used to attach the tag board 122 to the printing board 120. Other examples may include, but are not limited to clips, slots, pegs, etc.

As with the example shown in FIG. 1, it is noted that the printing board 120 and the tag board 122 may have any suitable shape. In FIG. 2A-2B, the printing board and the tag board are illustrated as being substantially rectangular in shape. However, other shapes are also contemplated. The shape and size of the printing board 120 and the tag board 122 may depend at least to some extent on design considerations (e.g., the size, shape and/or type of textile to be printed on).

Although not illustrated in FIGS. 2A-B, the first printing surface 112 may include shoulders (not shown), similar to the shoulders explained above with reference to FIG. 1.

Figure 3A:
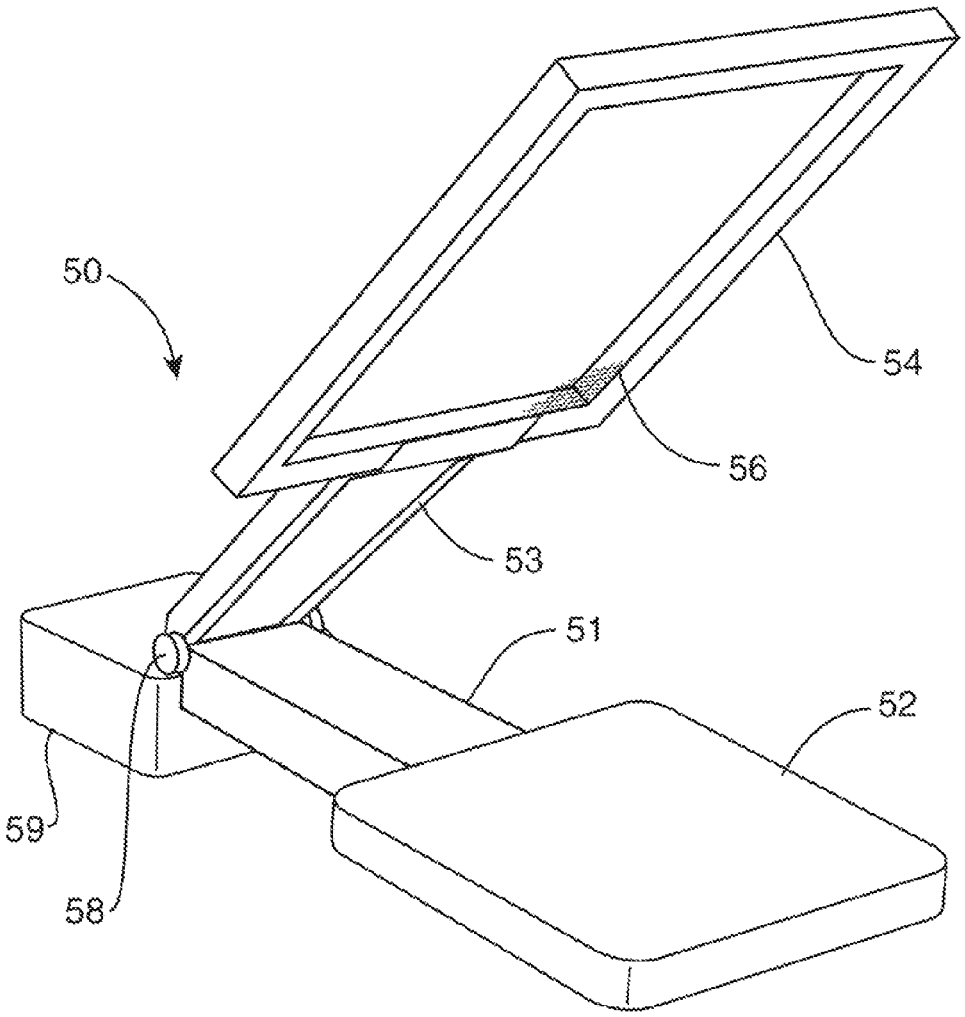
FIG. 3A shows an example screen print device.

FIG. 3A shows an example screen print device 50 as it may be implemented with textile printing practices that print on a single area of the garment. The screen print device 50 may include a platen 52 and a screen support 54 for a screen 56. In an example, the screen support 54 is movably connected by support arm 53 (e.g., via hinge 58) to the platen arm 51 which supports the platen 52. The screen print device 50 may be mounted to a stand (not shown), e.g., via mount 59, to raise the textile printing apparatus onto a rotating carousel for multiple stations and screens for multiple colors and designs. In an example, the stand is rotatable to bring the individual screen print devices before the operator so that multiple textiles can be printed by the operator without the operator having to move from one screen print device 50 to the next.

Figure 3B:
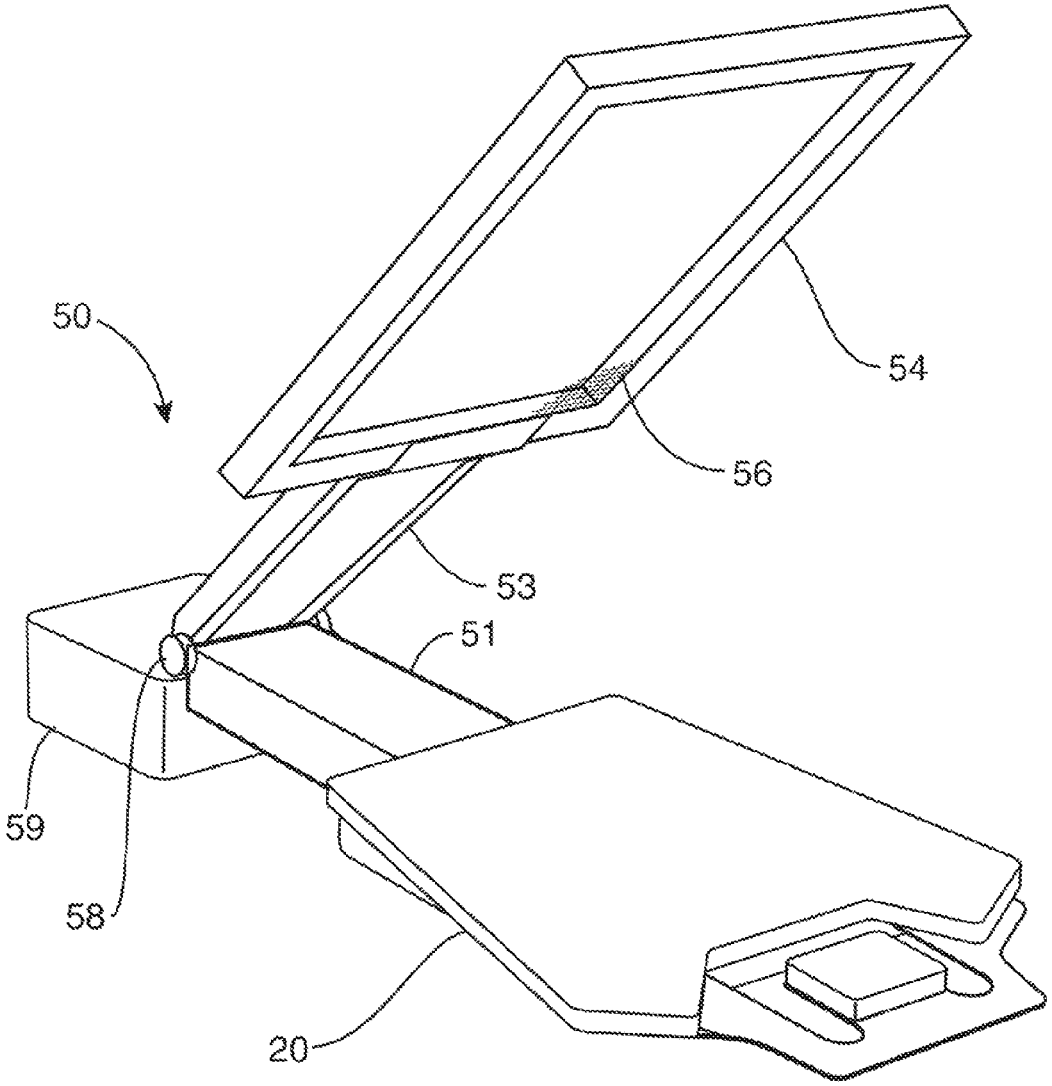
FIG. 3B shows an example textile printing apparatus as it may be implemented with the screen print device of FIG. 3A.

FIG. 3B shows the example textile printing apparatus 10 as it may be implemented with the screen print device 50 of FIG. 3A. In this example, the textile printing apparatus 10 is positioned on the arm 51.

Figure 4:
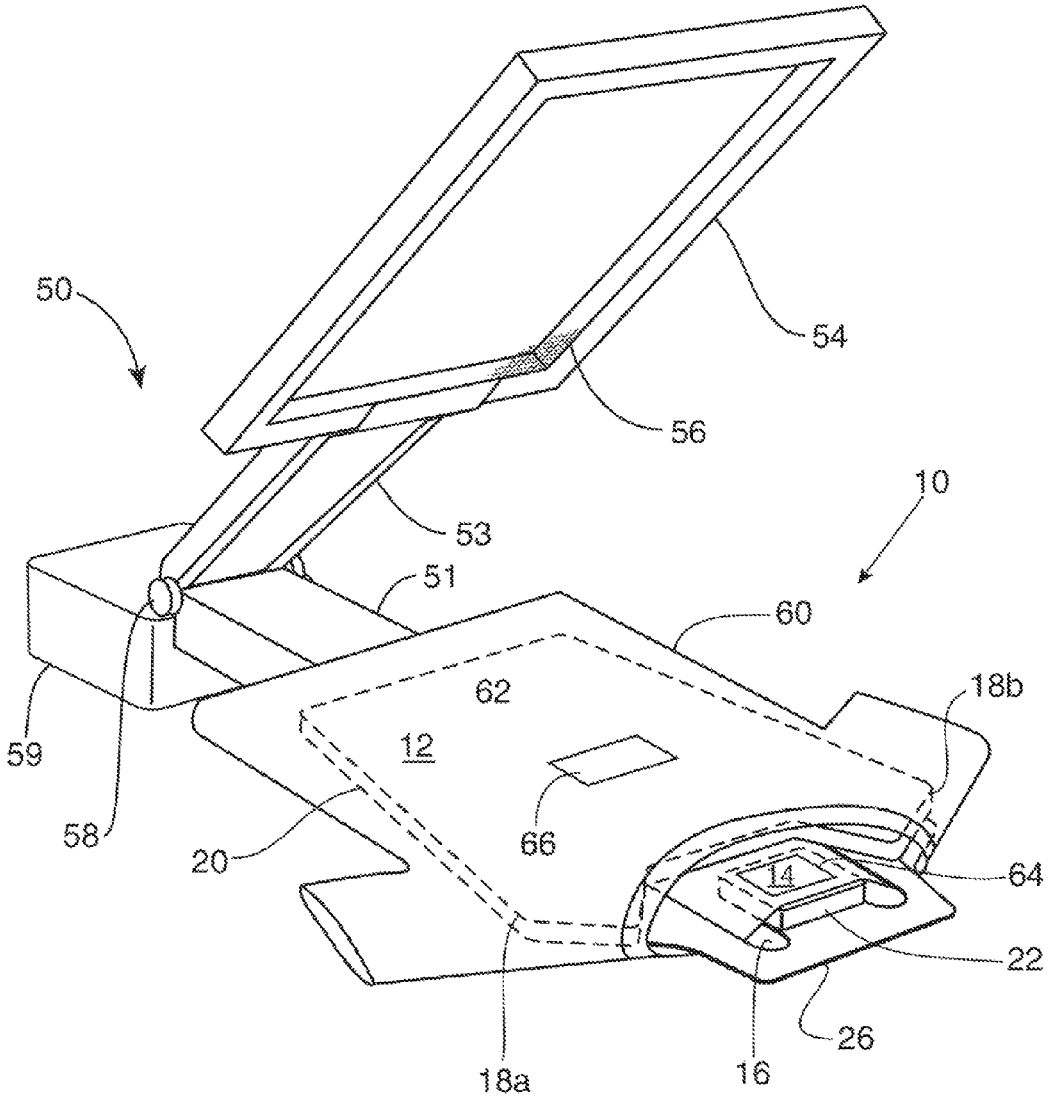
FIG. 4 shows an example textile printing apparatus with a garment mounted thereon for a printing operation.

FIG. 4 shows the example textile printing apparatus 10 with a garment 60 (e.g., a t-shirt) mounted thereon for a printing operation. In an example, a body 62 of the garment 60 is mounted over the first printing surface 12. An inner portion 64 of the garment 60 (e.g., inside of the t-shirt and just below the thicker portion of the collar) is pulled through the slot 16 and mounted over the second printing surface 14. As such, the second printing surface 14 provides a raised surface adjacent the slot 16. The raised surface is configured to support the inside of the shirt collar 64 so that a label or other graphic can be printed thereon at the same time and in substantially the same printing plane as the body of the shirt. That is, the printing operation proceeds in substantially the same printing plane to print a graphic 66 onto both the outer body of the garment 62 and the inner collar 64 of the same shirt, at about the same time, without having to remove the textile during the printing operation.

Before continuing, it should be noted that the examples described above are provided for purposes of illustration, and are not intended to be limiting. Other devices and/or device configurations may be utilized to carry out the operations described herein.

Figure 5A:
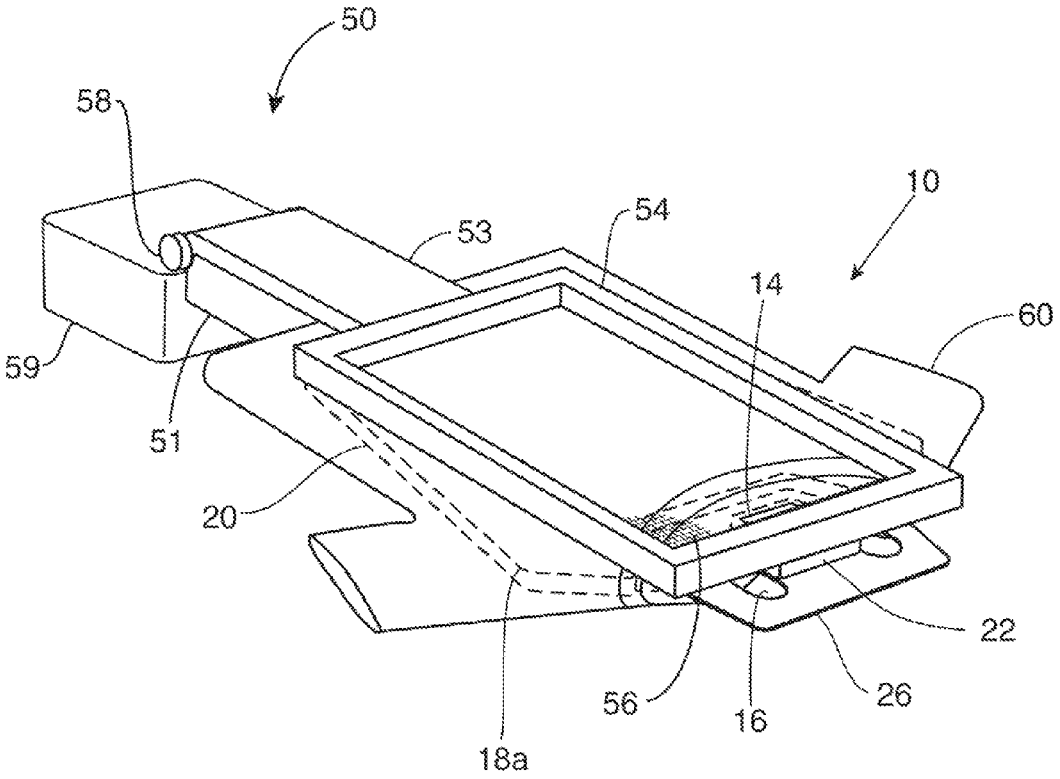
FIGS. 5A-D illustrate an example printing operation with an example textile printing apparatus.

FIGS. 5A-D illustrate an example printing operation with an example textile printing apparatus (e.g., apparatus 10 or 100). In FIG. 5A, the garment 60 has been configured on the textile printing apparatus 10 and assembled on the screen print device 50, e.g., as illustrated in FIG. 4. The screen support 54 is lowered such that the screen covers an area of the garment 60 to be printed on, in this example, including a portion of the front body of the shirt and the label area inside the shirt collar.

Figure 5B:
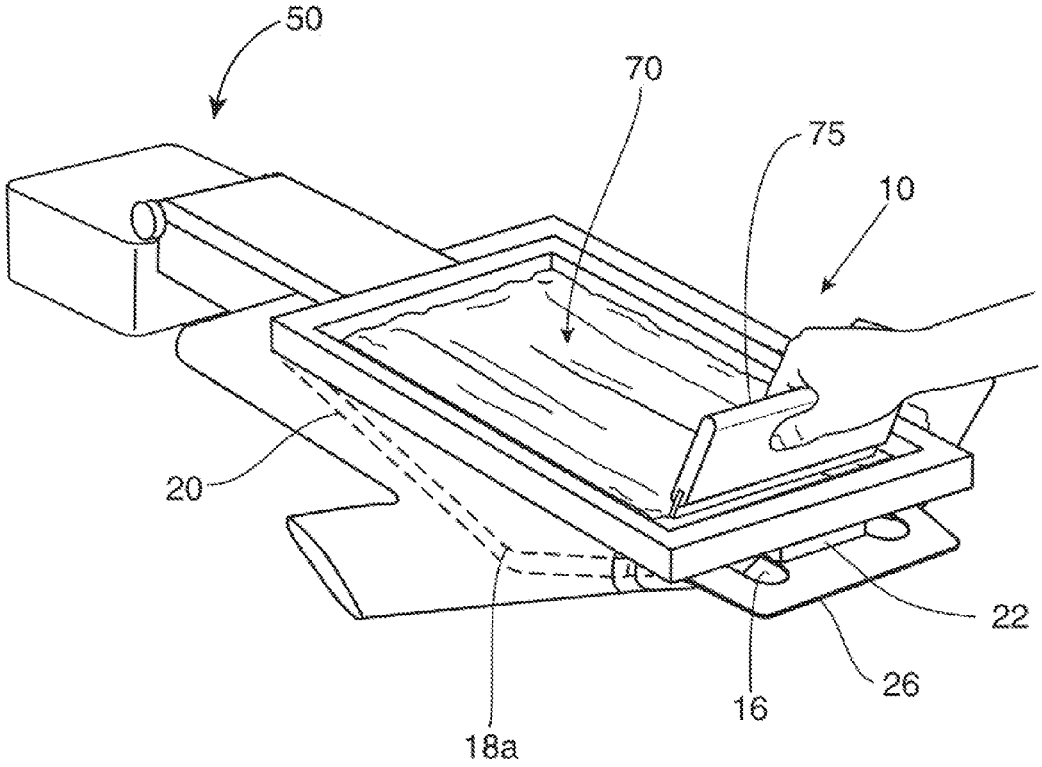
Figure 5C:
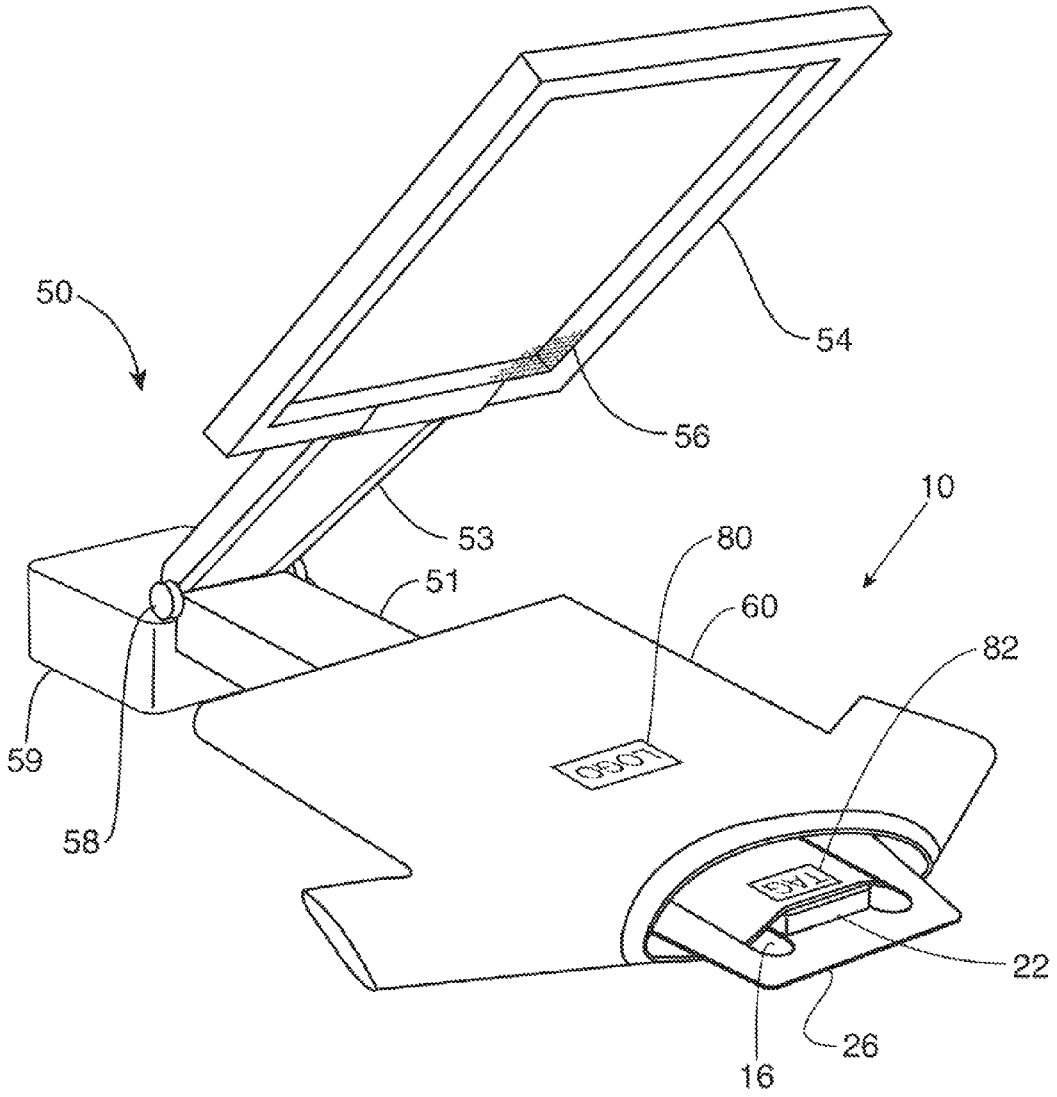

In FIG. 5B, ink 70 is applied over the screen 56 and wiped with a squeegee 75. This applies ink to the printed area on both the front body of the shirt and the label area inside the shirt collar at about the same time. Following application of the ink, the screen support 54 is raised as illustrated in FIG. 5C. It can be seen that ink has been applied to the printed area on both the front body of the shirt 60 (e.g., logo 80) and the label area inside the collar of the shirt 60 (e.g., label 82) at about the same time.

In an example, the printed garment 60 can be dried to prevent smearing of the ink during removal of the shirt from the textile printing apparatus 10. By way of illustration, the printed garment 60 and apparatus 10 may be at least partially cured using a flash dryer while the garment 60 is still on the apparatus 10. The textile printing apparatus 10 with garment 60 can then be removed from the screen print device 50, as shown in FIG. 5D.

Figure 5D:
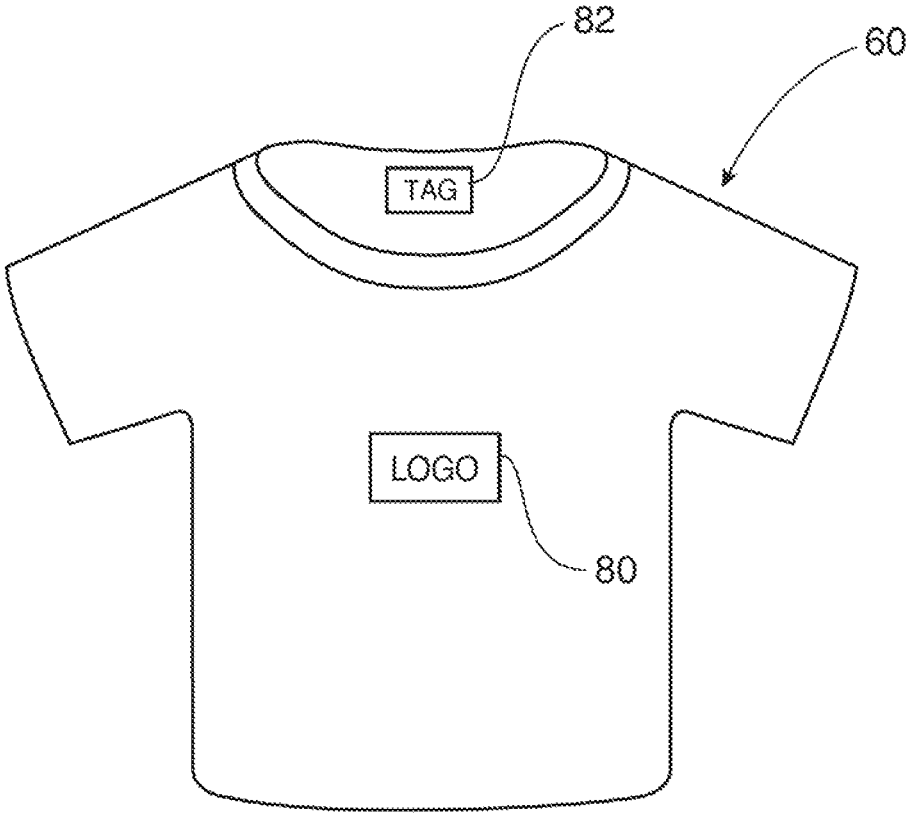

Although a logo and a label for shirt "tag") are illustrated in FIGS. 5C-5D, anything which can be printed can be printed in either or both of these area using the apparatus described herein. The logo 80 and tag 82 are shown only for purposes of illustration and are not intended to be limiting.

The operations shown and described herein are provided to illustrate example implementations. It is noted that the operations are not limited to the ordering shown. Still other operations may also be implemented. For example, the textile printing apparatus is not limited to screen printing, and may also be implemented with digital printing, or any other transfer method now known or later developed. It is also noted that various of the operations described herein may be automated or partially automated.

The examples shown and described are provided for purposes of illustration and are not intended to be limiting. Still other examples are also contemplated.

The invention claimed is:

1. A printing apparatus, comprising:

a printing board having a printing board width sized to support a full width of an outer surface of a textile to be printed on;

a tag board having a tag board width sized smaller than the printing board width to support an inner surface of the textile to be printed on;

a slot formed between the printing board and the tag board; and a raised surface of the tag board in substantially a same printing plane as an upper surface of the printing board, the raised surface configured to support the inner surface of the textile to be printed on in substantially a same printing plane as the outer surface of the textile to be printed on, wherein a single printing operation prints anywhere on the full width of the outer surface and on the inner surface of the textile to be printed on without having to remove the textile to be printed on from the printing board and the tag board.

2. The printing apparatus of claim 1, wherein the slot is a substantially U-shaped slot, the U-shape fully enclosed between the printing board and the tag board.

3. The printing apparatus of claim 1, wherein the printing board is a platen configured for a graphic to be printed on the textile.

4. The printing apparatus of claim 1, wherein the raised surface is configured for a label to be printed on the textile.

5. The printing apparatus of claim 1, wherein the printing board and the tag board are formed as an integral unit.

6. The printing apparatus of claim 1, wherein the printing board and the tag board are separate units connected to each other.

7. The printing apparatus of claim 1, wherein the printing board comprises a shoulder to support a squeegee passing from the printing board across the slot to the raised surface, the shoulder at least partially surrounding the tag board.

8. A textile printing apparatus, comprising:

a first printing surface having a first width sized to support a full width of an outer surface of a textile to be printed on;

a second printing surface having a second width sized smaller than the first width to support an inner surface of the textile to be printed on, the second printing surface configured to support the inner surface of the textile in substantially a same printing plane as the outer surface of the textile; and a slot formed adjacent the second printing surface;

wherein a body of the textile is mounted over the first printing surface, and an inner portion of the textile is pulled through the slot and mounted over the second printing surface, wherein a printing operation proceeds in substantially the same printing plane onto both the outer printing surface and the inner printing surface of the textile without removing the textile during the printing operation.

9. The textile printing apparatus of claim 8, wherein the slot is substantially a U-shape, the U-shape fully internal between the printing board and the tag board.

10. The textile printing apparatus of claim 8, wherein the second printing surface is raised to substantially the same printing plane as the first printing surface.

11. The textile printing apparatus of claim 8, wherein the second printing surface is an attachable device removable from the first printing surface.

12. The textile printing apparatus of claim 8, wherein the second printing surface has shoulder portions configured to support a squeegee traveling from the first printing surface to the second printing surface during the printing operation, the shoulder portions forming substantially a U-shape at least partially surrounding the tag board.

13. The textile printing apparatus of claim 8, wherein the first printing surface is a shirt platen and the second printing surface is a separate tag platen.

14. The textile printing apparatus of claim 13, wherein the shirt platen and the separate tag platen are configured to screen print a first graphic on a body of a shirt and a tag graphic on an inside collar of the shirt during a same printing operation.

15. The textile printing apparatus of claim 8, wherein the textile comprises any substrate for a printing operation.

16. The textile printing apparatus of claim 8, wherein the first printing surface is a platen configured to support a shirt for screen printing.

17. The textile printing apparatus of claim 8, wherein the first printing surface is a platen configured to support a shirt for digital printing.

18. A method of preparing for printing a label on an inner portion of a garment while at the same time printing on an outer portion of the garment, comprising:

providing a first printing surface having a first width sized to support a full width of the outer portion of the garment in a smooth and taut arrangement;

providing a second printing surface having a second width sized smaller than the first width to support an inner surface of the garment to be printed on, the second printing surface configured to support the inner portion of the garment in a smooth and taut arrangement substantially in a same printing plane as the outer portion; and further comprising receiving a body of the garment for mounting over the first printing surface, and receiving an inner portion of the garment adjacent a collar through a U-shaped slot formed adjacent the inner printing surface such that the inner portion of the garment is mounted over the second printing surface, wherein printing proceeds in substantially the same printing plane onto both an outer printing surface and an inner printing surface of the garment without removing the garment.

* * * * *